US005795144A

United States Patent [19]

Tung

[11] Patent Number: 5,795,144

[45] Date of Patent: Aug. 18, 1998

[54] FUEL-FIRED BURNERS

[75] Inventor: Ming-Biu Tung, London, Great Britain

[73] Assignee: British Gas plc, London, Great Britain

[21] Appl. No.: 726,931

[22] Filed: Oct. 7, 1996

[30] Foreign Application Priority Data

Oct. 6, 1995 [GB] United Kingdom ..... 9520450

[51] Int. Cl.[6] ..... F23C 11/04

[52] U.S. Cl. ..... 431/1; 126/512

[58] Field of Search ..... 126/512, 502; 431/1

[56] References Cited

U.S. PATENT DOCUMENTS

| | | | |
|---|---|---|---|
| 816,154 | 3/1906 | D'Arsi | 431/1 |
| 830,092 | 9/1906 | Matthews et al. | 431/1 |

FOREIGN PATENT DOCUMENTS

| | | |
|---|---|---|
| 0 093 816 | 11/1983 | European Pat. Off. . |
| 1 455 558 | 11/1976 | United Kingdom . |
| 2 168 472 | 6/1986 | United Kingdom . |
| 2 280 023 | 1/1995 | United Kingdom . |

*Primary Examiner*—Carroll B. Dority
*Attorney, Agent, or Firm*—Oblon, Spivak, McClelland, Maier & Neustadt, P.C.

[57] ABSTRACT

A fuel fired burner 1 is for use in a solid fuel effect fire such as a coal effect fire 40. The burner 1 has ports 3 for supporting a decorative effect flame. Each port 3 is connected to an electrically driven arrangement 2. When the burner is in use the arrangement 2 operates so as to vary automatically and continually the aeration of the fuel/air mixture which exits from the burner ports 3. The resulting flames supported by the burner ports are thus of continually changing visual appearance and provide a realistic decorative live flame effect.

15 Claims, 4 Drawing Sheets

FUEL-FIRED BURNERS

The present invention relates to fuel-fired burners and, more particularly, to so-called solid fuel effect fires, such as coal or log effect gas fires, incorporating such burners.

Some known solid fuel effect space heating fires are available with imitation flame effects. Such effects may be operated by electricity. For example, a flicker intended to imitate the flames of a real coal or log fire, may be produced by spinners mounted on pivots over light bulbs and rotated by a current of warm air rising from a burner below. The flickering light is seen by an observer through imitation solid fuel and/or as reflected light from a wall of surface behind the imitation solid fuel.

Other known solid fuel effect space heating fires are termed 'live flame effect fires'. In, for example, fuel gas fires of this kind, one or more actual flames emerge from, or from between, imitation solid fuel material.

For any given heat input to the fire these decorative effect flames are generally constant, i.e. they do not change substantially in appearance over a period of time during which the fire is in use.

An object of this invention is to provide a burner which produces a more dynamic or realistic decorative live flame effect.

To this end, from a first aspect the invention provides a fuel fired burner for use in a solid fuel effect fire, the burner having at least one burner port for supporting a decorative effect flame, in which the port is connected to a power driven means which, when the burner is in use, is operable so as to vary automatically and continually the aeration of the fuel/air mixture which emerges from the burner port such that the flame supported by the burner port is of continually changing visual appearance.

The burner may have two or more such decorative flame effect burner ports. In this case the aerating varying means may be arranged to vary the aeration to both or all of the ports in such a manner that for the majority of the time the means is operating the appearance of the flame at any one port is different to the appearance of the flame at the other port or at least at one of the other ports.

The means may vary the aeration at the or each port in a substantially cyclical manner.

In order to enhance the dynamic and decorative effect of the flames, the means may be arranged so as to vary the primary aeration at the or each port such that the flame supported therefrom varies between being a blue flame and a yellow flame.

In the case, for example, of a fuel gas burner, when air is mixed with the fuel gas upstream of the burner port and before combustion, i.e. primary aeration or pre-aeration, a relatively small blue flame is produced. When the amount of primary air is gradually reduced the fuel gas relies on more and more secondary air diffusing into the gas downstream of the burner port, i.e. post-aeration, an increasing tall and increasing yellow flame is produced.

To further simulate the dynamic appearance of flames associated with actual solid fuels, the decorative effect varying means of the burner may be arranged so as to vary the primary aeration at the or each port such that the flame, during the stage when it is yellow, momentarily becomes detached from the port.

This can be achieved by arranging for there to be a quick transition from a yellow flame supported substantially completely by secondary air (and substantially no primary air) to a blue flame resulting from a premixture of fuel gas and air arriving at the burner port and requiring little or virtually no secondary air.

During such a quick transition, at substantially the same time as the flame starts to retract in size and burns with a blue flame, a 'pocket' of unburnt fuel gas is still momentarily rising up and moving away from the port and still combusting to provide a yellow flame as oxygen in the secondary air diffuses inwardly to the unburnt gas. This produces the effect of a flickering yellow flame that lifts or rises into the air and then disappears or vanishes. This effect produces an even more realistic appearance to the decorative flame as this kind of 'vanishing' flame occurs when actual coal or wood logs are burnt.

The power driven means may comprise a movable member having one or more openings in communication with a source of oxygen, for example ambient or surrounding air, and a stationary member having one or more holes to which the port is, or respective ones of the ports are, connected by conduit means for conveying air (as pre-aeration air) towards the port or ports. The movable member is movable in a substantially repetitive manner and such that at various times and to different extent the or each opening overlaps with the or one of the apertures thereby placing the, or the associated, burner port in communication with the source of air. Thus, as the movable member moves and the extent of overlap of the opening(s) and hole(s) changes, the appearance of the flame(s) at the port(s) also changes.

The movable member may have different sized openings whilst the stationary member may have substantially equisized holes.

The movable member may be a rotatable member, in which case one of the rotatable member and stationary member may be located inside the other member, the rotatable member being provided with the or each opening, and the stationary member being provided with the or each hole.

In one form, the rotatable member may be generally cylindrical and be mounted in a complimentary cylindrical recess provided in the stationary member, with the cylindrical wall of the rotatable member being provided with the or each opening and the corresponding wall of the stationary member being provided with the or each hole.

Conveniently, the rotatable means is provided with a spindle via which rotary movement is transferred to the rotatable member.

From a second aspect, the invention provides a solid fuel effect fire, such as a fuel-gas space heating fire, incorporating a burner according to the first aspect of this invention.

The invention will now be further described, by way of example only, with reference to the accompanying drawings, in which.

Figure 1:
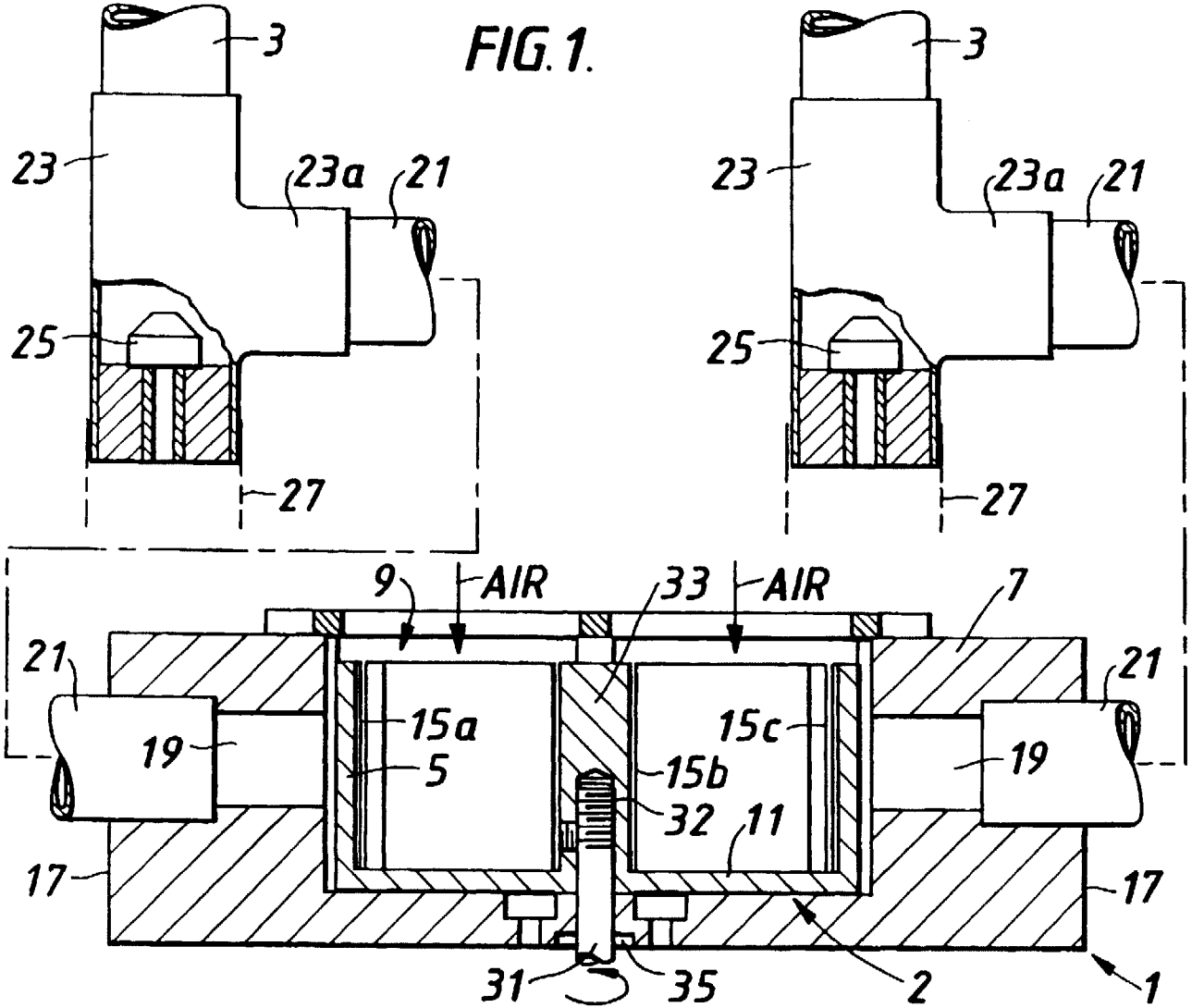
FIG. 1 is a somewhat schematic view of one embodiment of burner according to the invention.
Figure 2:
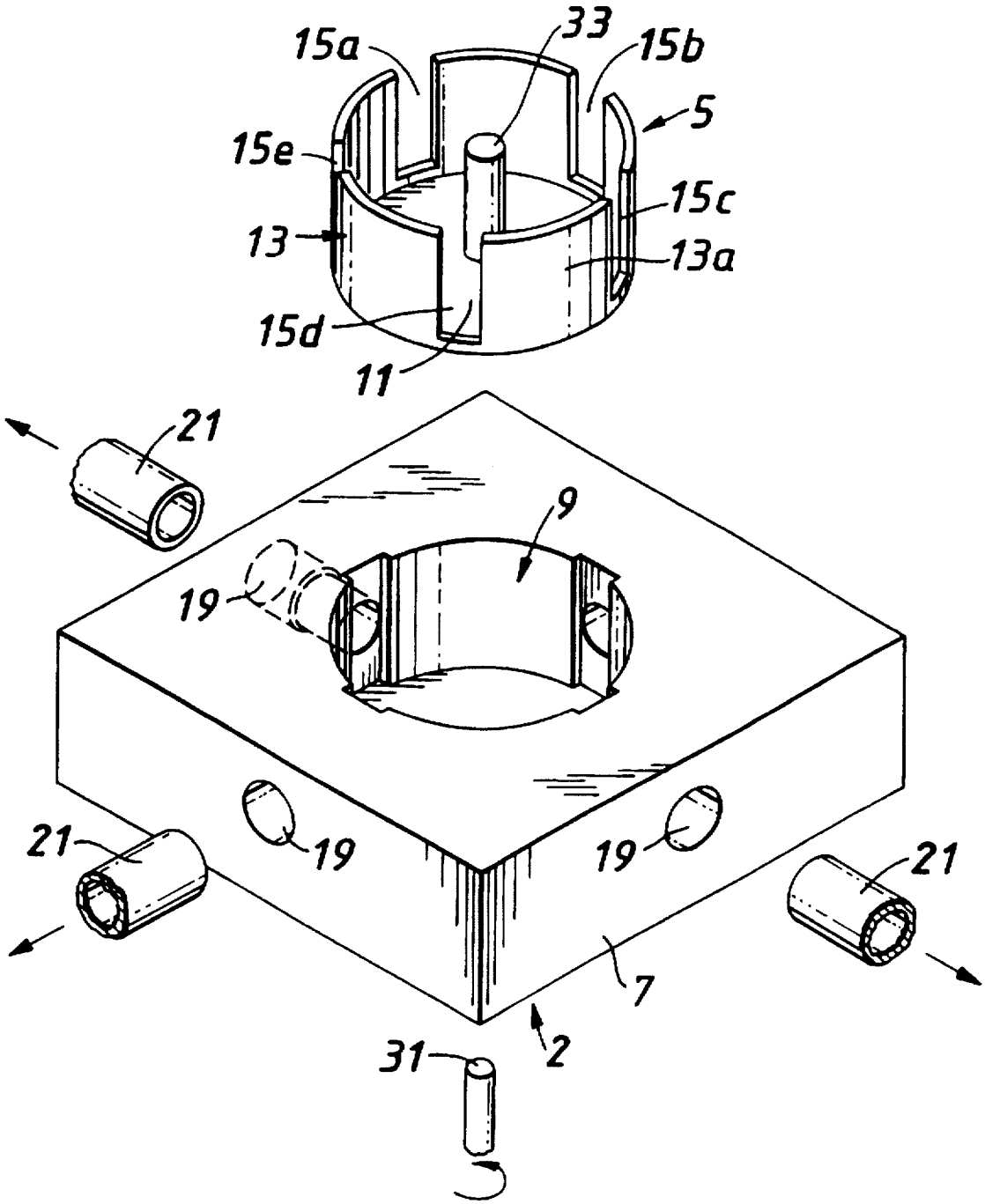
FIG. 2 is an exploded perspective view of the relatively rotatable parts of the burner shown in FIG. 1.

Referring to FIGS. 1 and 2, the burner 1 comprises a power drivable means 2 for varying automatically and continually the pre-aeration of the fuel gas/air mixture supplied to burner ports 3.

The means 2 comprises a first movable part 5 of generally cylindrical form and a second stationary part 7 in the form of a generally square block having a complimentary cylindrical recess 9 in which the cylindrical part 5 is mounted and is rotatable.

The cylindrical part 5 comprises a circular base 11 and a cylindrical wall 13 extending upwardly from the periphery of the base and having cut-out openings 15*a*, 15*b*, 15*c*, 15*d* and 15*e* between cylindrical wall segments 13*a*.

Each side wall 17 of the block 7 is provided with a through hole 19 with each such hole providing communication between the recess and the outside of the block.

In this particular embodiment, three of the holes 19 are used. Respective pipes 21 are fitted at one end into the holes 19 and at the other end are connected to a branch portion 23*a* of a tube 23 extending from fuel gas nozzles 25 to respective burner ports. Fuel gas supply pipes or lines are connected to the gas nozzles 25 as indicated by chain lines 27 when the burner is installed and ready for use in, for example, a coal effect fire.

A drive spindle 31 is located in a recess 32 in a hub-like portion 33 at the centre of the rotatable part 5. The spindle 31 extends through an aperture 35 in the base of the block 7.

Figure 4:
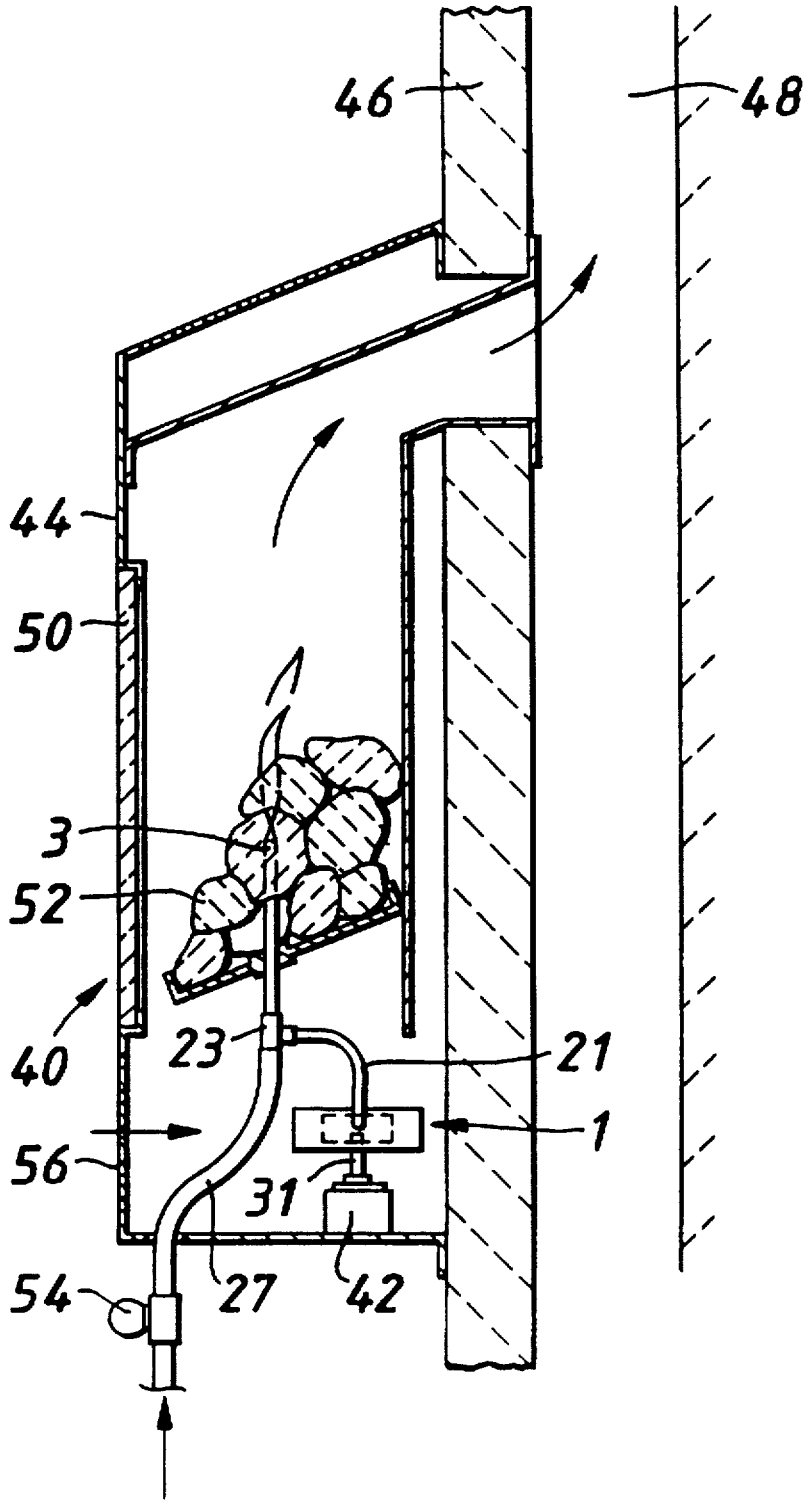
FIG. 4 is a schematic view from one side of the fire shown in FIG. 3.

When the burner 1 is mounted in a gas fire 40 the spindle 31 is connected to a rotary drive means such as an electric motor as shown at 42 in FIG. 4.

The stationary part 2 and the rotatable part 5 may be made, for example, of plastics material. The two parts are, of course, so arranged and constructed that the rotatable part is readily rotatable in the stationary block.

Figure 3:
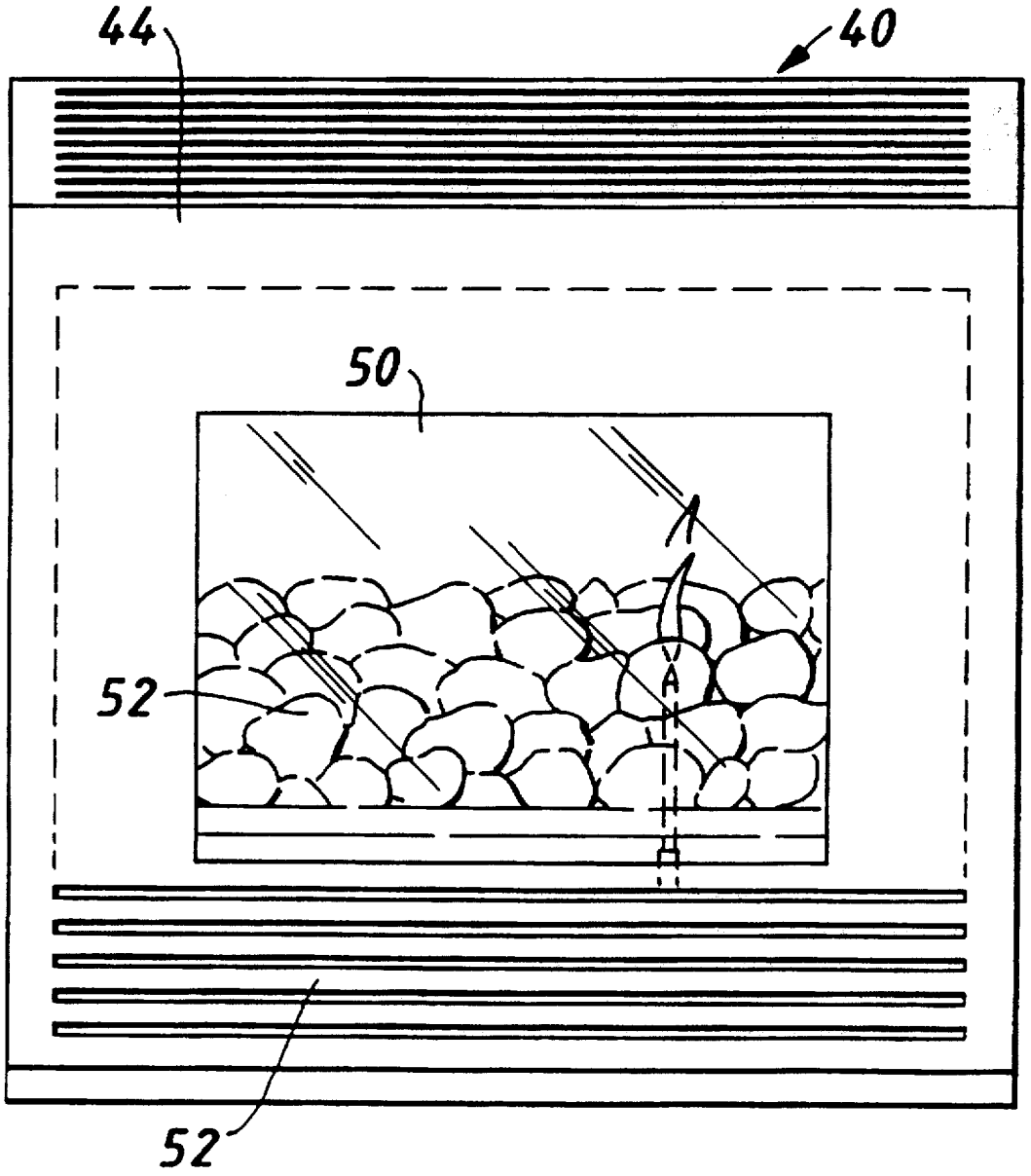
FIG. 3 is a schematic view from the front of one embodiment of a solid fuel effect space heating fire incorporating a burner as shown in FIGS. 1 and 2.

FIGS. 3 and 4 show, schematically, a solid fuel effect space heating gas fire 40. The fire comprises a housing 44 mounted on a wall 46 such that gaseous products of combustion pass to the chimney 48. The housing has a transparent panel 50 in its front. As viewed through the panel 50 there is supported in the housing 44 an arrangement or pile of ceramic logs or coals 52 to simulate the appearance of an actual log or coal fire.

The housing 44 also houses the burner 1 described in FIGS. 1 and 2. For sake of simplicity, just one of the three burner ports 3 is shown in FIGS. 3 and 4. The port 3 is positioned within the ceramic logs or coals preferably so as not to be visible when the logs or coals are viewed through the glass panel.

Again for the sake of simplicity, the main heat generating gas burner of the fire has not been shown.

The tube 27 is connected to a supply of fuel gas via on/off control valve 54, and the spindle 31 is connected to small electric motor 42.

An apertured cover 56 is fitted over the open top of the rotary part and this enables the hole 19 in the stationary to communicate with ambient air which enters the housing 44 via a grill 56 in the lower front part of the housing.

In operation, the gas supply to the burner ports 3 is turned on, the electric motor 42 is switched on, and the gas emerging from ports is ignited by energising ignition means (not shown).

As the rotary part 5 rotates, at any instant in time the hole 19 is fully closed, or partially or fully open to the ambient air, depending on the position of the openings 15*a*, 15*b*, 15*c*, 15*d* and 15*e* and wall segments 13*a* as they pass directly in front of the hole 19. Each of the openings is of different width and each of the wall segments is of different width such that the flame appearing at the port 3 constantly changes in accordance with the pattern of the alternating openings and wall segments for each rotation of the rotary part. As mentioned earlier, depending on the extend to which the hole is covered or not covered by the wall segments at any particular moment, different amounts of primary air is entrained into the tube 23 as the fuel gas issues into the tube via the nozzle 25 so that the flame at the outlet of the port 3 varies between being a blue flame and a yellow flame, and so that periodically an upper portion of a yellow flame becomes detached from the flame as the flame changes towards being a blue flame.

It will be apparent that the arrangement is also such that at any one instant the extent to which each different hole 19 is open/closed at any one instant is different from that of the other holes and thus the visual appearances of the flames at the ports are different, i.e. the flames at the ports are out of phase with each other.

The arrangement is so designed that a plurality of dynamic flames that continually grow and shrink in size and are out of phase with each other is produced.

Whilst a particular embodiment has been described above, it will be understood that various modifications may be made without departing from the scope of the invention. The manner in which the rotatable part is caused to rotate may be different. For example, the electric motor may be omitted and the spindle depending from the rotatable part may carry a vane device which, in response to an upward draught from below of channelled warm air from, for example, the main burner, rotates to cause the spindle and thus the rotatable part to rotate. In another modification, the stationary part may comprise an apertured flat disc with the pipes 21 connected to the apertures, and the rotary part may comprise a flat disc which is also apertured or provided with gaps through its thickness. When the rotary part is caused to rotate the apertures in the two parts overlap to different extents on a cyclical basis and again different amounts of primary air are entrained into the ports 3.

I claim:

1. A fuel fired burner for use in a solid fuel effect fire, the burner having at least one burner port supplied with a fuel for supporting a decorative effect flame, in which the port is connected to a power driven means for automatically and continually varying the aeration of the fuel/air mixture which emerges from the burner port by varying the air flow to said burner port, such that the flame supported by the burner port is of continually changing visual appearance.

2. A burner as claimed in claim 1, having two or more of the decorative flame effect burner ports, wherein the aeration varying means varies the aeration to both or all of the burner ports in such a manner that for the majority of the time the means is operating the appearance of the flame at any one port is different from the appearance of the flame at the other port or at least at one of the other ports.

3. A burner as claimed in claim 1, in which the means varies the aeration at the or each port in a substantially cyclical manner.

4. A burner as claimed in claim 1, in which the means varies the aeration at the or each port such that the flame varies between being a blue flame and a yellow flame.

5. A burner as claimed in claim 4, in which the means so varies the aeration at the port or ports that the yellow flame momentarily becomes detached from the port or ports.

6. A burner as claimed in claim 1, in which the means comprises a movable member having one or more openings in communication with a source of air, and a stationary member having one or more holes to which the port is, or respective ones of the ports are, connected by conduit for conveying air towards the port or ports, the movable member being movable in a substantially repetitive manner and such that at various times and to different extent the or each opening overlaps the or one of the apertures thereby placing the, or the associated, burner port in communication with the source of air.

7. A burner as claimed in claim 6, in which the movable member has different sized openings and the stationary member has substantially equi-sized holes.

8. A burner as claimed in claim 6 or 7, in which the movable member is a rotatable member.

9. A burner as claimed in claim 8, in which one of the members is located inside the other member, the rotatable member being provided with the or each opening and the stationary member being provided with the or each hole.

10. A burner as claimed in claim 9, in which the rotatable member is of generally cylindrical form and is mounted in a complimentary cylindrical recess provided in the stationary member, the cylindrical wall of the rotatable member being provided with the or each opening and the corresponding wall of the stationary member being provided with the or each hole.

11. A burner as claimed in claim 8, in which the rotatable means is provided with a spindle via which rotary movement is transferred to the rotatable member.

12. A burner as claimed in claim 1, in which the burner is a fuel-gas fired burner.

13. A fuel fired appliance, incorporating a burner as claimed in claim 1.

14. An appliance as claimed in claim 13, in the form of a space heating fire.

15. An appliance as claimed in claim 14, in the form of a solid fuel effect fire.

* * * * *